US007850445B2

(12) United States Patent
Bechard

(10) Patent No.: US 7,850,445 B2
(45) Date of Patent: Dec. 14, 2010

(54) OIL PREHEATER FOR A MULTI OIL BURNER

(76) Inventor: Ryan Thomas Bechard, 6539 50th Ave., Chippewa Falls, WI (US) 54729

( * ) Notice: Subject to any disclaimer, the term of this patent is extended or adjusted under 35 U.S.C. 154(b) by 0 days.

(21) Appl. No.: 10/709,693

(22) Filed: May 24, 2004

(65) Prior Publication Data

US 2004/0241602 A1 Dec. 2, 2004

(51) Int. Cl.
*F23D 11/44* (2006.01)

(52) U.S. Cl. ..... 431/210; 431/11; 431/239; 431/266

(58) Field of Classification Search ..... 431/208, 431/210, 207, 239, 159, 161, 11, 343, 264, 431/266; 239/128, 135, 137; 165/164, 165
See application file for complete search history.

(56) References Cited

U.S. PATENT DOCUMENTS 1,564,592 A * 12/1925 Laster ..... 431/217
2,235,664 A * 3/1941 Bachmann ..... 431/208
2,976,918 A * 3/1961 Leach ..... 431/41
3,865,185 A * 2/1975 Ostbo ..... 165/165
4,067,682 A * 1/1978 Lado ..... 431/11
4,719,877 A * 1/1988 Delage ..... 431/210
4,797,089 A * 1/1989 Schubach et al. ..... 431/208
5,067,894 A * 11/1991 Bender ..... 431/208
5,156,139 A * 10/1992 Wilson, Jr. ..... 431/208
5,341,832 A 8/1994 Foust ..... 137/202
5,551,868 A 9/1996 Smoker et al. ..... 431/208
5,649,515 A * 7/1997 Fuchs et al. ..... 123/557
5,879,149 A 3/1999 Briggs et al. ..... 431/208

FOREIGN PATENT DOCUMENTS

FR 2 304 030 A * 11/1976

* cited by examiner

*Primary Examiner*—Steven B McAllister
*Assistant Examiner*—Sarah Suereth
(74) *Attorney, Agent, or Firm*—Mark A. Litman & Associates, P.A.

(57) ABSTRACT

A device and method of preheating oil for use in a multi oil burner that uses a heated liquid to convey heat energy to oil. The device is made of a thermally conductive material which has a passageway for oil and a passageway for a heated liquid. Heat energy from the heated liquid conductively transfers to the oil within the device. This method of preheating oil for combustion eliminates carbon creation and minimizes oil preheat temperature fluctuations thereby significantly lowering the cost and maintenance to operate a multi oil combustion system.

8 Claims, 5 Drawing Sheets

OIL PREHEATER FOR A MULTI OIL BURNER

CROSS REFERENCE TO RELATED APPLICATIONS

This application claims the benefit of provisional patent application Ser. No. 60/320,227, filed on May 28, 2003 by Ryan Bechard.

BACKGROUND OF INVENTION

This invention relates generally to heating appliances such as furnaces and boilers, specifically for the purpose of preheating heavy oil fuels for combustion.

Considerable waste oil is generated as a result of the spent oil garnered from the crankcases of millions of automobiles and trucks whenever the oil is changed. The disposal of the vast quantities of discarded oil constitutes a great problem. Some waste oil is cleaned and is then resold. Unfortunately, many people choose to illegally dump oil rather than pay to have it properly disposed.

When properly performed, efficient and complete incineration of waste oil provides many benefits. While large waste oil generators often receive a small reimbursement for their waste oil, smaller generators, usually end up paying to have it removed off site. Retaining waste oil and utilizing it for heating, versus burning a purchased fuel, results in immediate savings. In most cases, the cost of waste oil heating equipment is returned in one to three years. With this invention, the cost of preheating and maintenance is minimized, the savings are greater and therefore the return on investment faster. Incineration of waste oil is a government approved and encouraged method of recycling providing elimination of a substance considered hazardous.

Four process elements are needed for the combustion of heavier virgin heating and spent lubricating oils. First, and most importantly, because heavier oil fuels are too thick to atomize and spray at ambient temperature, they must be preheated. The heated oil becomes reduced in viscosity enabling it to be finely atomized.

Second, is the atomizing of heated oil. Atomization is accomplished by spraying heated oil out of a nozzle. An aeration process involving an air atomizing nozzle and compressed air is one method. The air atomizing nozzle mixes oil and compressed air resulting in a conical fine spray of atomized oil ejecting away from the nozzle. Typically only 10-15 pounds per square inch of air pressure along with 1-10 pounds per square inch of oil pressure is all that is needed. Another method of atomization is accomplished by substituting the nozzle with a standard oil pressure nozzle and placing the oil under higher pressure, typically 100-150 pounds per square inch. With this invention, either method of atomization can be used.

Third, is igniting the atomized oil. This process ignites the spray and creates the combustion flame that incinerates the atomized oil. The ignition process is typically performed by an igniter which has a pair of electrodes which emit an electrical arc across in close proximity to the atomized spray.

Fourth, is controlling all of the processes needed for combustion. It is important that the combustion process be performed in a way that is precisely controlled with safety components and features to assure a safe, reliable and thorough incineration of oil. The control system empowers and manages all the mechanical and electro-mechanical devices needed to control all the process elements mentioned above.

Most prior art oil combustion preheat systems use thermostatically controlled high wattage electrical heating elements to preheat oil. This invention utilizes a heated liquid to preheat oil. All heavy oil fuels need to be preheated in order to yield the fluid flow characteristics that combustion equipment requires.

This invention is a multi oil preheat device used within a combustion system for the incineration of many types of oils. This invention transfers heat energy from a heated liquid to oil prior to being incinerated. This method produces many advantages over prior art's thermostatically controlled electrical element preheat systems. The heated liquid this invention uses can come from any source including a boiler that the invention is installed on. When the invention is installed on a boiler it is able to utilize the heat energy created by the combustion process itself versus consuming electricity to create heat energy for preheating.

Prior art's method of preheating oil requires an outside source of electrical energy to energize electric heating elements. These elements heat a device that the oil flows through just prior to reaching a nozzle. The oil is heated by one or more electrical elements either in direct contact with the electrical element or indirectly by conduction through the body of the preheat device.

U.S. Pat. No. 5,067,894 to Bender in 1991 shows a preheat device located inside a burner constructed of an elongated square metal block that has electrical elements installed inside of it. U.S. Pat. No. 5,341,832 to Foust in 1994 shows a preheat device located in a burner constructed of a metal cylindrical preheat device that has electrical elements installed inside of it. U.S. Pat. No. 5,551,868 to Smoker et al. in 1996 shows a preheat device located inside a burner constructed of a rectangular metal block which also has electrical elements installed inside of it.

U.S. Pat. No. 5,879,149 to Briggs et al in 1999 shows a canister shaped preheat device located external to the burner. Inside the preheat device is an electric element which is inserted into a metal apparatus. The element apparatus assembly is installed inside a cylindrical canister. Oil enters the canister and is heated as it passes around the element apparatus assembly. Oil then travels from the external canister to yet another electrically powered preheat device located inside the burner.

These are just a few examples of the many patented preheat inventions that accomplish similar results using thermostatically controlled electric elements to preheat oil. The prior art preheat devices all entail one or more electric elements that are thermostatically controlled in various shapes, configurations and locations on or in a burner. These prior art inventions all consume a significant amount of electricity to preheat oil for combustion. These electrically preheated burners loose a percentage of their oil energy savings due to their high electrical consumption.

Another disadvantage with prior art's preheat devices is that thermostatically controlled electrical elements are slow to react. When used to preheat oil, their method produces temperature fluctuations of the oil's temperature in the preheat process. These temperature swings mandate frequent maintenance and create many problems within a combustion system.

Within the prior art's electrically heated preheat device, oil is vulnerable to overheating at the high peak of an electrical element's temperature swing. Over heated oil produces carbon crystals within the preheat device causing coagulation and clogging of the oil passageway and nozzle resulting in equipment failure. Oil is vulnerable to carbonization at temperatures as low as 90 degrees Centigrade. The surface temperature of an energized electric element can reach several hundred degrees centigrade.

At the low end of the thermostatically controlled electrical element's temperature swing, the quality of oil atomization decreases. This often happens before prior art's thermostat turns on the electric heating elements because the thermostat is slow to react to the oil temperature. When oil cools, it thickens, thus reducing the quality of oil atomization as the oil droplet size increases. These larger droplets, if not completely incinerated, will project past the flame where they can accumulate and build up unburned fuel inside the furnace or boiler. This unburned oil fuel accumulation can propose a serious hazard to the end user.

Within this invention, a heated liquid of consistent temperature is circulated. Heat energy is exchanged from the heated liquid through the device to the oil as it passes through the device. The oil is brought to and maintained at an optimal atomization temperature with minuet temperature fluctuations prior to combustion. With this invention, oil can not reach a temperature any hotter than the liquid with which it is being heated. With this invention's method of preheating, carbon creation is eliminated because preheat temperature fluctuations are vastly minimized. Whereas oil is vulnerable to carbonization from direct overheating, a liquid such as a water glycol solution is not. Using a liquid to convey heat energy to oil for preheating removes the risk of overheating and carbonizing oil. The liquid acts as a buffer that absorbs temperature extremes and fluctuations between the heat source and oil.

A significant disadvantage of using prior art's electrical elements to preheat oil is their tendency to overheat the oil. Over time, this causes the oil to carbonize inside the preheat device thus creating many problems in the combustion process. The carbon crystals created by overheated oil, will plug the nozzle causing equipment failure. The coagulation of carbonized oil inside the passageways of the prior art's preheat device restricts the oil flow causing inconsistent combustion and eventual equipment failure. Carbon build up inside the oil channels insulates the oil from the heat source.

Gradual carbon coagulation on the inner surface of the heat transfer boundaries forces prior art's electric elements to remain on longer thus further increasing carbon build up. Eventually the prior art's preheat device must be removed from the heating appliance, disassembled, cleaned out, reassembled and reinstalled back onto the heating appliance. An operator of the prior art preheat invention is typically required to send the combustion system back to the manufacture or qualified manufacture's distributor to have the overhauling process performed. This problem is so prevalent in the industry that manufactures, or their distributors, offer customer training on overhauling procedures. Overhauling costs an owner of the prior art inventions a significant amount of time and money to keep the system operable.

This invention uses a heated liquid that is maintained at approximately 80 degrees centigrade to preheat oil minimizing temperature fluctuation. Since the oil's temperature can't exceed the heated liquid's temperature, carbon creation and the removal thereof does not need to be performed. This significant advantage makes this invention much more attractive to the end user.

The prior art's preheat devices using thermostatically controlled electrical elements, once energized, heat up very slowly, typically 5 to 15 minutes. Because they heat up slowly, they must keep the oil hot inside the preheat device in between burn cycles in order to be prepared for the next burn cycle. The time between burn cycles is when the majority of carbonization forms due to the constant overheating of the dormant oil inside the device.

With this invention, the oil is heated rapidly, typically within 15 to 30 seconds, prior to a burn cycle. The oil is heated from an ambient temperature to an ideal temperature for atomization just prior to a burn cycle. Because of the high speed of heat conduction from the heated liquid to oil, this invention does not need to keep the dormant oil inside the preheat device heated in between burn cycles. Also, electrical energy consumption needed to keep the dormant oil heated between burn cycles is eliminated.

Another disadvantage of using thermostatically controlled electric elements to preheat oil is that of reduced safety. Because of high element temperatures, prior art preheat systems must implement vast safety systems to prevent a fire. In the event that the prior art's control system were to fail causing an element to remain energized, a potential fire hazard could occur. Prior art's control system is extremely complex with sensors, switches, wiring and controllers to prevent a hazardous condition. In summary, using thermostatically controlled electrical elements to preheat oil is inefficient, undependable, potentially hazardous and is expensive to maintain.

Using a heated liquid to preheat oil is extremely safe. No fire hazard is caused by circulating a liquid between the heated liquid source and the invention. The control system for this invention simply energizes a pump to circulate a heated liquid. There are only a few components involved with this preheat invention. The prior art's preheat systems involve many moving parts, sensors, wiring, controllers and components vulnerable to failure causing equipment malfunction and a hazardous condition.

A significant advantage of this invention is having the option of capturing and utilizing heat energy from the combustion process to preheat oil rather than consuming electricity to create heat energy for preheating. The method of using a heated liquid does not overheat oil eliminating the many problems caused by carbonized oil creation and large preheat temperature fluctuations as found in the prior art. Therefore, the cost of incinerating multiple oil fuels with this invention is significantly less than the prior art.

The multi oil heating market has long sought a reliable and cost effective means of incinerating heavier oil fuels for heating purposes and waste oil elimination. Many oils such as spent lubricating oil, industrial heating oil and cooking oils burn very efficiently when appropriately preheated and incinerated within a combustion system. In an age demanding higher efficiencies with regard to energy usage, this invention provides a much more efficient method of incinerating both heavy virgin and used oil fuels.

SUMMARY OF INVENTION

Disclosed herein, is a liquid heated multi oil fuel preheat device that makes it possible to incinerate many types of heavier virgin and used oil fuels in a combustion process. This invention entails a method of preheating oil using a heated liquid to provide many benefits to the end user. Several objects and advantages of the present invention are:

a. to provide a multi oil preheat device that offers a means of capturing heat energy present in the combustion process to be used for preheating oil prior to combustion.

b. to provide a multi oil preheat device that eliminates the creation of carbonized oil and eliminates the excessive maintenance costs involved with carbon removal.

c. to provide a multi oil preheat device at significantly improves the dependability of a multi oil combustion system.

d. to provide a multi oil preheat device that significantly minimizes preheat temperature fluctuations thus producing stable, predictable, dependable and safer combustion of heavier oil fuels.

e. to provide a multi oil preheat device that rapidly preheats oil thus eliminating the need to keep oil heated in between burn cycles.

f. to provide a multi oil preheat device that is mechanically simple and practical.

g. to provide a multi oil combustion preheat system that is safe to operate.

h. to provide a multi oil combustion preheat system that can use combustion heat for preheating oil that is more efficient and costs less to operate.

DETAILED DESCRIPTION

Figure 1:
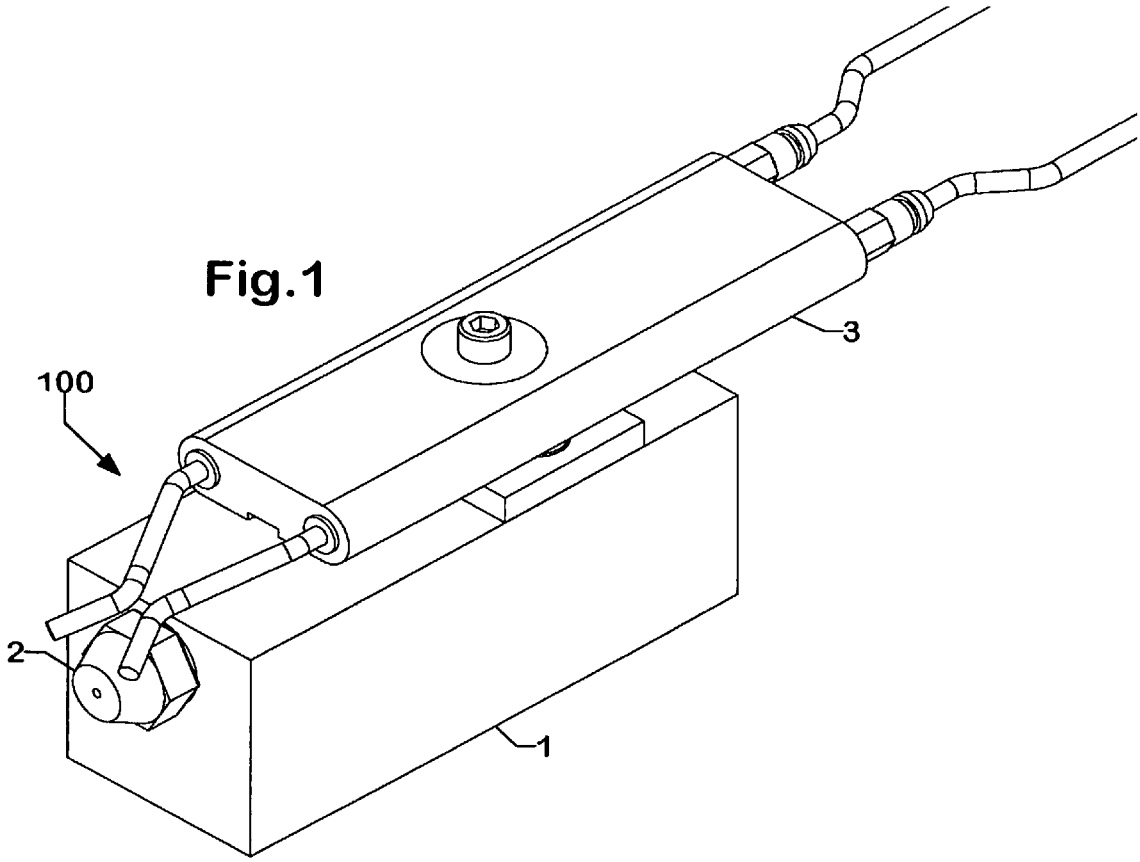
FIG. 1 is an isometric view from the left front of the present invention.
Figure 2:
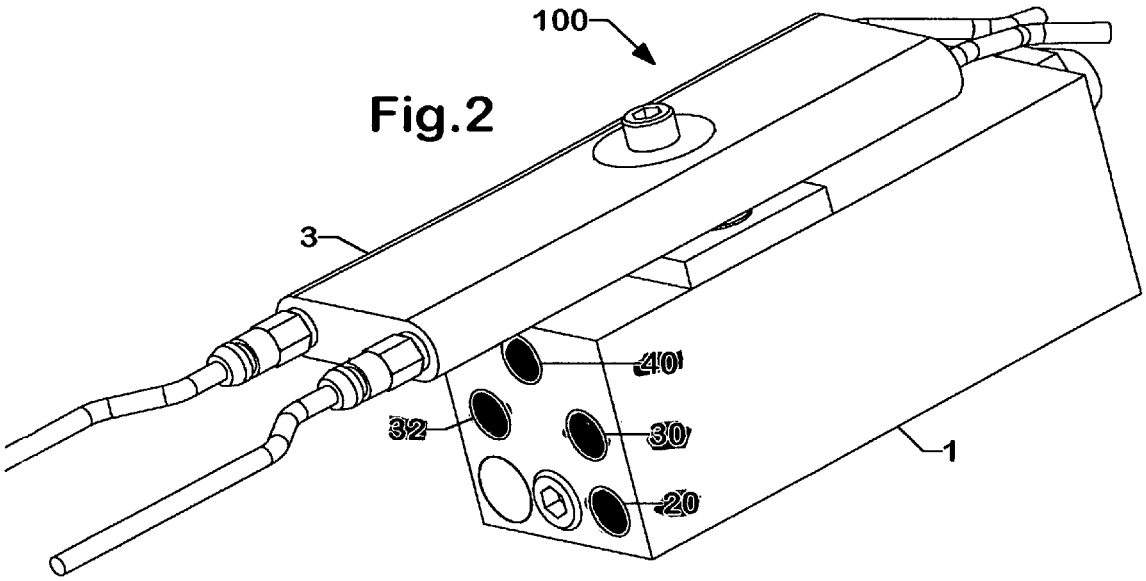
FIG. 2 is an isometric view from the right rear of the present invention.

A preferred embodiment of the present liquid heated multi oil preheat invention is illustrated in FIGS. 1 and 2 isometric views. The present invention, a liquid heated multi oil preheat device 1 is shown with a nozzle 2 and an igniter 3 attached to it which provide a means of atomizing and igniting the preheated oil as was previously described. This assembly comprising of preheat device 1, nozzle 2 and igniter 3 will be referred to as assembly 100. Within preheat device 1, the materials of combustion are directed and distributed to nozzle 2 via machined channel circuits. Inside preheat device 1 there is a heated liquid passageway which allows a heated liquid to circulate within while conductively transferring heat energy through preheat device 1 to oil and compressed air as it passes through preheat device 1 to nozzle 2. These channels will be discussed later in more detail with FIGS. 3, 4, 5 and 6. In its simplest form, preheat device 1 is a liquid to liquid heat exchanger. Nozzle 2 is an air atomizing nozzle recognized by anyone skilled in the art of multi oil combustion. Igniter 3, recognized by anyone skilled in the art, is used to provide ignition of the oil spray ejecting out of nozzle 2.

FIG. 2 is an isometric view of the right and back side of assembly 100 and preheat device 1 showing the entrances of a compressed air channel 40, a heated liquid channel 30 and a heated liquid channel 32, and an oil channel 20.

Figure 3:
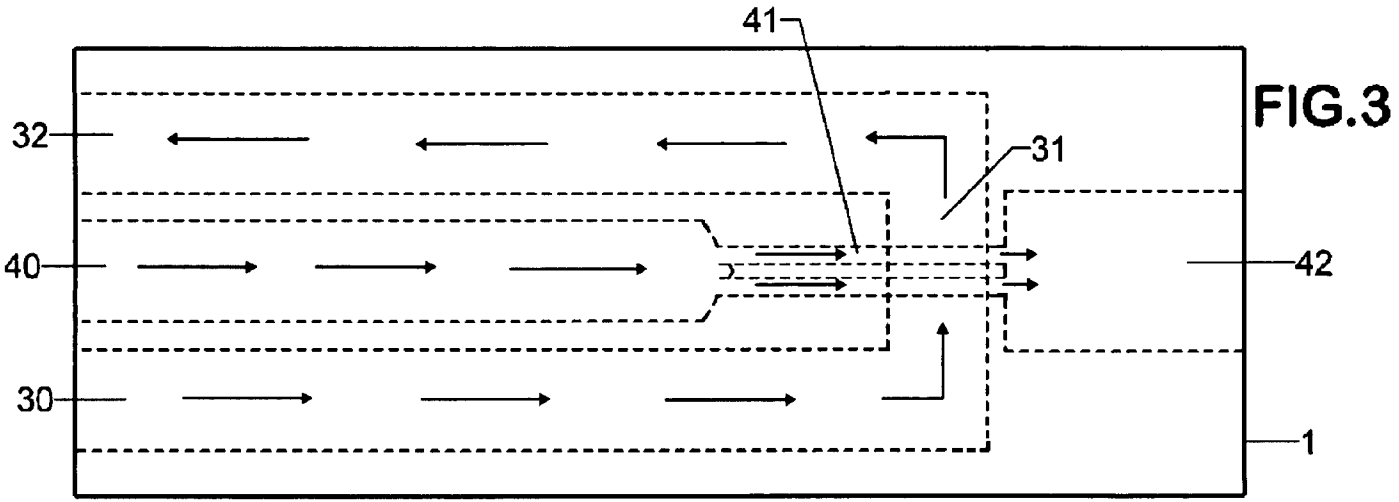
FIG. 3 is a top view of the present invention using dashed lines to represent the compressed air passageway and heated liquid passageway inside the invention.
Figure 4:
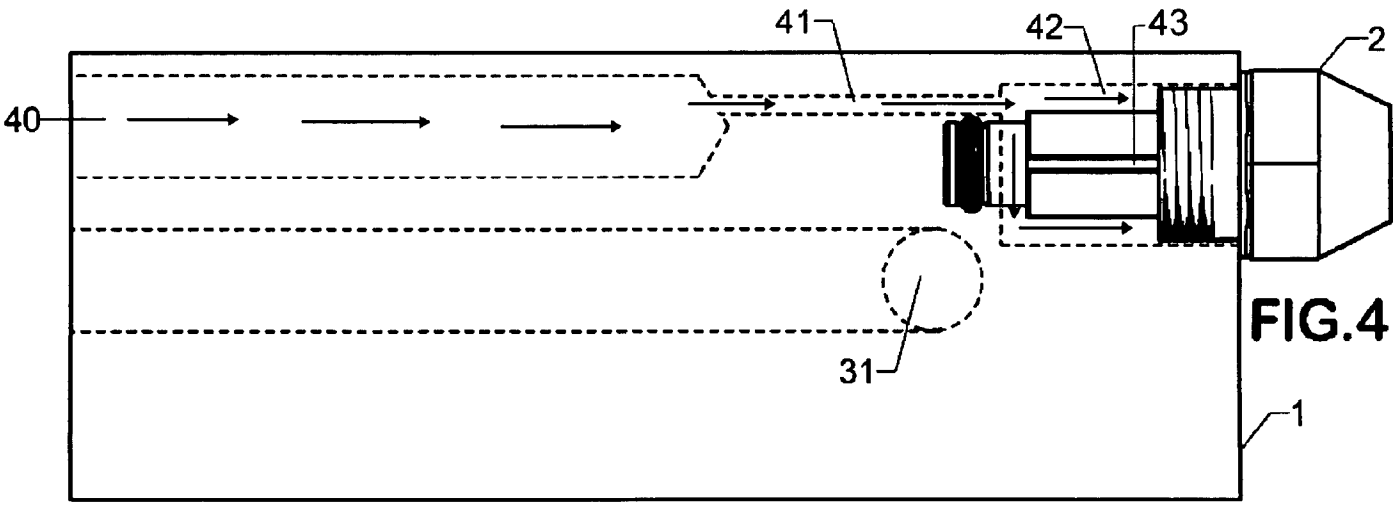
FIG. 4 is a side view of the present invention using dashed lines to represent the compressed air passageway and heated liquid passageway inside the invention.

Referring now to FIGS. 3 and 4 for this paragraph, the dashed lines represent tiered or layered channels or passageways machined into preheat device 1. The arrows represent the flow direction of the compressed air, heated liquid and oil. These channels provide the passageways which heat preheat device 1 and direct the air and oil to nozzle 2. A heated liquid passageway comprises continuous liquid channels 30, 31 and 32. A heated liquid enters channel 30, flows to channel 31 and then to channel 32 afterwards exiting preheat device 1. While doing so, heat energy is conductively transferred to preheat device 1. A compressed air passageway overlies the liquid channel 30, 31 and 32 and comprises compressed air channels 40, 41 and 42. Compressed air enters compressed air channel 40 and is heated by heat energy transferred from heated liquid channels 30, 31 and 32 to preheat device 1 as it passes through compressed air channels 40 and 41 to channel or cavity 42 which cavity 42 supports a threaded end of the nozzle 2. A pair of narrowed channels 41 supply the heated air to the channel or cavity 42.

With this invention, either a high oil pressure or compressed air atomization method can be used. It is simply a matter of inserting the correct type of atomizing nozzle according to the method required. Air atomizing nozzles have compressed air passageways 43 whereas high pressure nozzles do not. If a high pressure nozzle is used, the narrowed air passageway 41 is blocked due to the design of the nozzle. The narrowed compressed air passageway 41 is provided to give the end user the benefit of choosing which atomization method to use.

Figure 5:
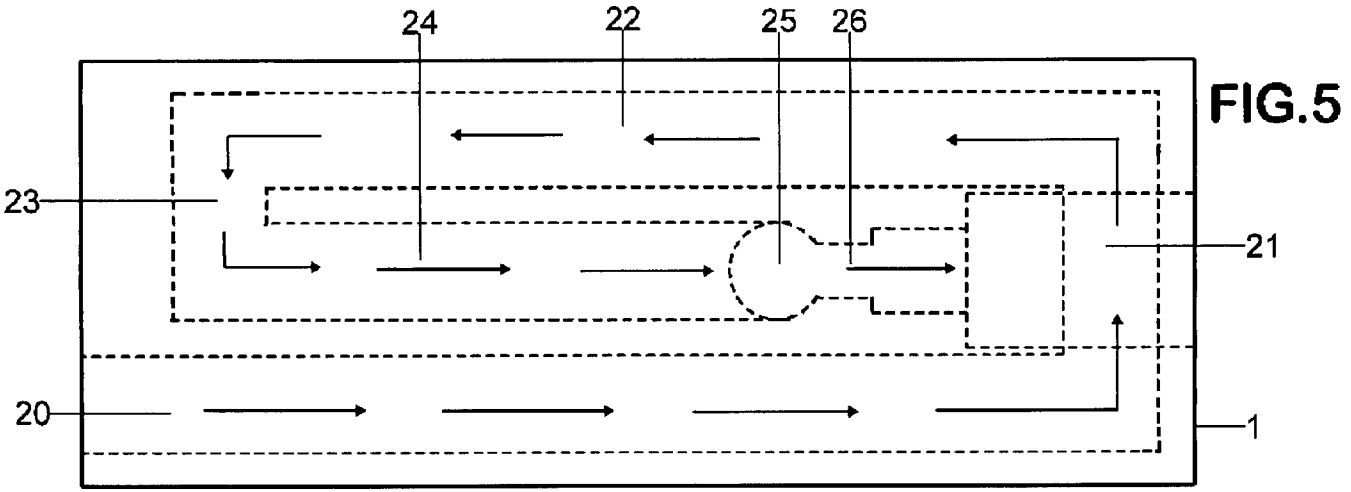
FIG. 5 is top view of the present invention using dashed lines to represent the oil passageway inside the invention.
Figure 6:
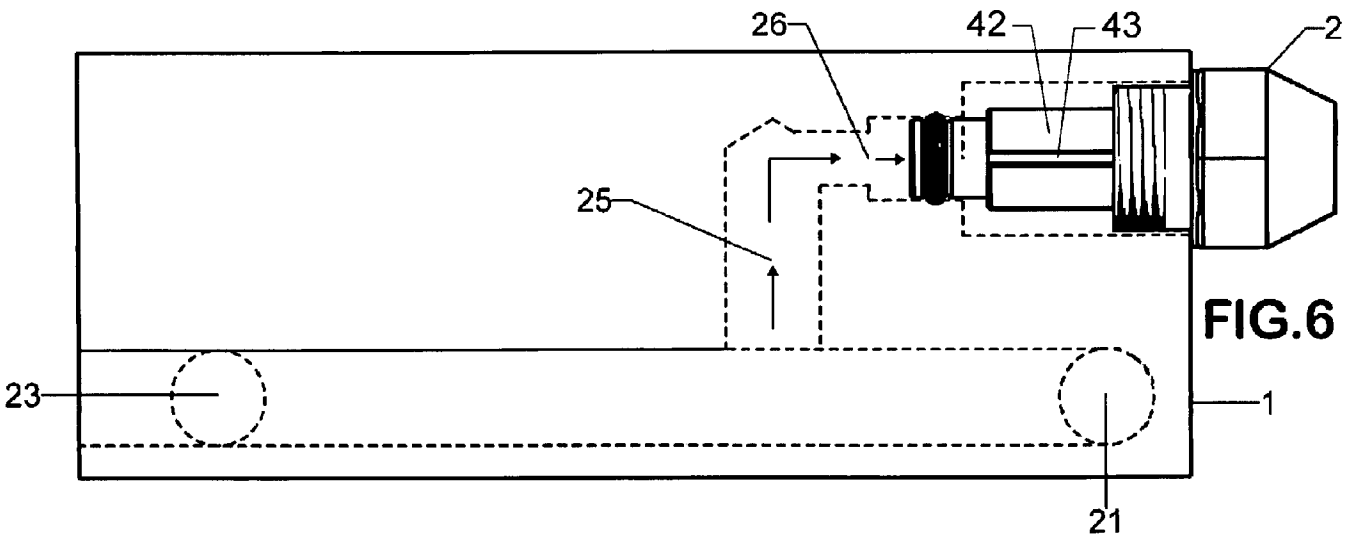
FIG. 6 is a side view of the present invention using dashed lines to represent the oil passageway inside the invention.
Figure 7:
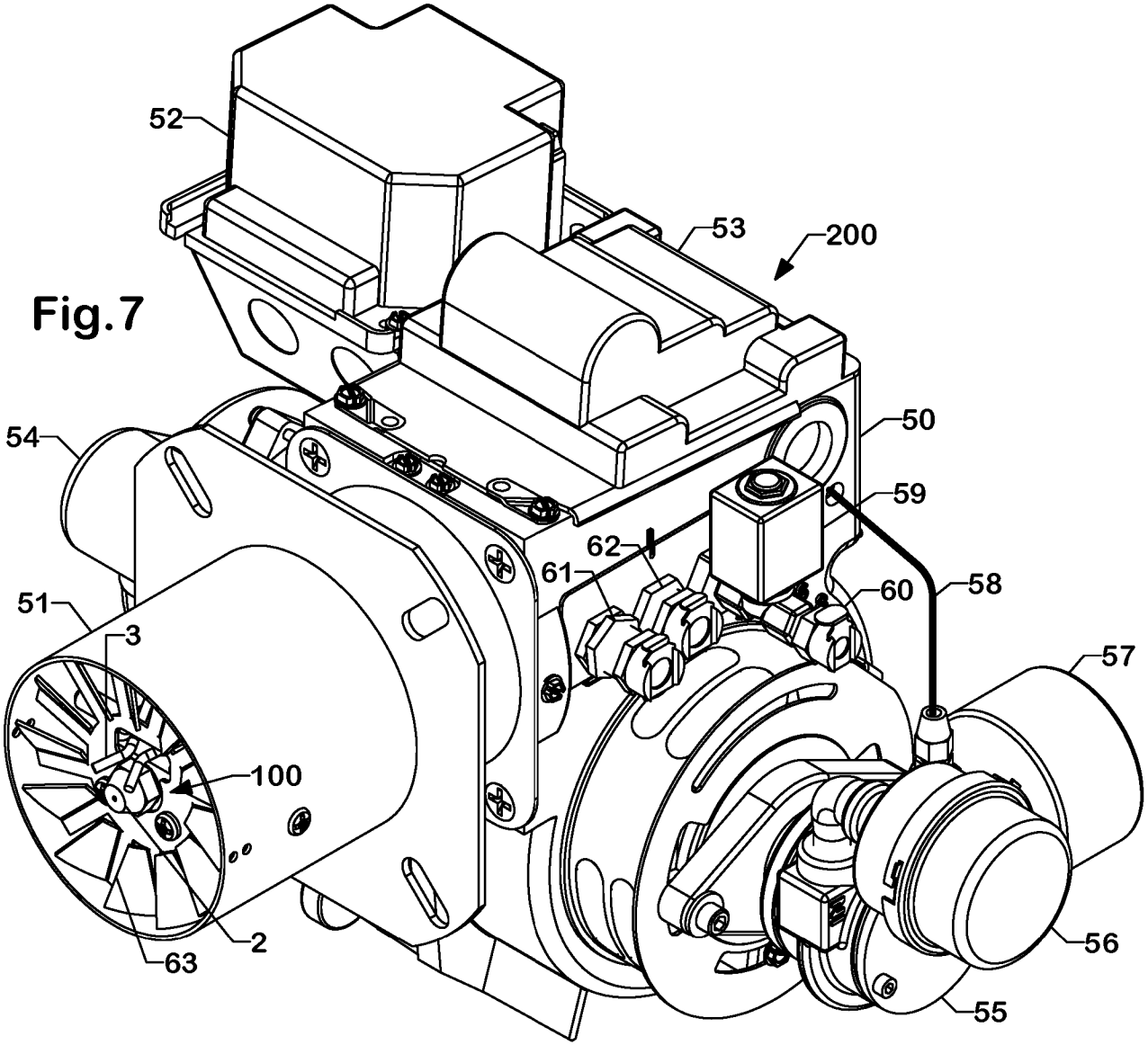
FIG. 7 is an isometric view of the present invention installed inside of a typical fuel oil burner.

Referring to FIGS. 5 and 6, an oil passageway is provided by continuous oil channels 20, 21, 22, 23, 24, 25, and 26. The flow of the oil to be incinerated is indicated by arrows. The oil enters channel 20 and is heated by preheat device 1 as it flows through the lower tier oil channels 20 through 24. The oil is then directed through the overlying tier of heated liquid channels 30-32 via riser channel 25 to channel or cavity 26 which cavity 26 supports an aft end of nozzle 2. Heat energy is provided and conductively transferred from heated liquid channels 30, 31 and 32, previously described, to preheat device 1. The heat energy is then conductively transferred to the oil inside oil channels 20 through 26 of preheat device 1. Using compressed air, see FIG. 7, provided by an air compressor 55 combined with an oil pump 74, nozzle 2 atomizes and sprays the heated oil in a conical shaped pattern. Or, instead of using compressed air, oil pump 74 could be used to place the oil under higher pressure and force it out of nozzle 2 using an appropriate high pressure nozzle. This spray is ignited by an electrical arc emitted across the ends of igniter 3 above nozzle 2.

FIG. 7 shows the preferred embodiment of assembly 100 installed in a burner 200 which is typical and recognized by anyone skilled in the art or HVAC. There are many manufacturers of fuel oil burners such as the R. W. Beckett AFG shown in FIG. 7. A custom burner could be fabricated that comprises of the same components. This embodiment shows air compressor 55 mounted in place where an oil pump would usually be mounted. Air compressor 55 also utilizes an air filter 56 to clean particulate out of incoming air. A pressure gauge 57 shows the air pressure between air compressor 55 and nozzle 2. An air line 58 provides the plumbing needed to transport the compressed air to preheat device 1. Also shown on this embodiment is a solenoid valve 59 which provides a definite opening and closing of an orifice allowing oil flow to nozzle 2.

Referring yet to FIG. 7, burner 200 comprises of a housing chassis 50 that holds the components in place. An air tube 51 has a flange for mounting burner 200 to a heating device such as a furnace or boiler, not shown. Air tube 51 also provides a means of mounting assembly 100 to burner 200. Housing chassis 50 also provides a means of mounting and ducting of a forced air system providing air needed for combustion. A squirrel cage type blower, not shown, inside housing chassis 50 is fastened to and driven by a motor 54. Fresh air enters the side of housing chassis 50, passes through the squirrel cage blower, not shown, and is forced into air tube 51. The air then passes around assembly 100 and into a combustion chamber of the heating device, not shown, that burner 200 is installed on. An electrical ignition transformer 53 receives electricity from a primary controller 52 and increases the voltage for energizing the ignition system's igniter 3 shown in Fig 1. A retention head 63 forces the combustion air into a spiral, tornadic pattern around the oil spray ejecting from nozzle 2 which helps mix the combustion air into the combustion flame.

Quick connect fittings provide fast disconnection and reconnection of the plumbing to burner 200 for expedited appliance clean out. Referring to both FIGS. 7 and 8, a quick connect fitting 60 provides fast connection of an oil line 75 to burner 200. Quick connect fitting 60 is connected to oil channel 20 of preheat device 1 via plumbing, not shown, inside burner 200. A quick connect fitting 61 provides fast connection of a heated liquid supply line 72 to burner 200. Quick connect fitting 61 is connected to heated liquid channel 30 of preheat device 1 via plumbing, not shown, inside burner 200. A quick connect fitting 62 provides fast connection of a heated liquid return line 73 to burner 200. Quick connect fitting 62 is connected to heated liquid channel 32 of preheat device 1 via plumbing, not shown, inside burner 200.

Figure 8:
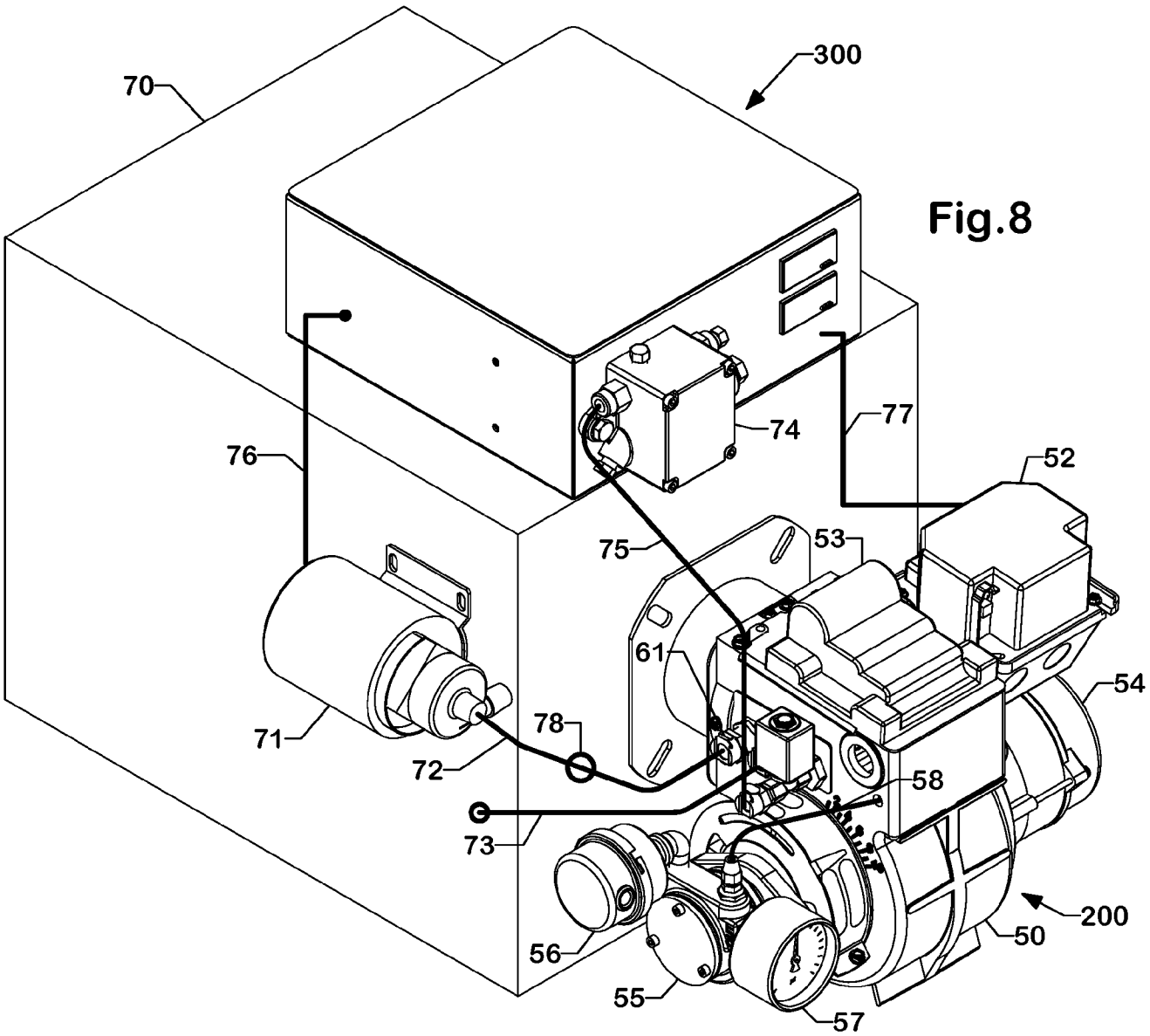
FIG. 8 is an isometric representation of the burner containing this invention in FIG. 7 mounted on a boiler.

Referring to FIG. 8, burner 200 and necessary components needed to operate the invention are mounted on a heating device such as a boiler 70 which will be referred to in this paragraph. A control system 300 uses mechanical and electromechanical devices to control distribution of oil, heated liquid and air to assembly 100 and operate burner 200. A primary controller 52 is the central processing unit of the operation and is energized by control system 300 via a primary controller wiring 77. Primary controller 52 works in conjunction with control system 300 to energize and operate the components of burner 200. Control system 300 has a motor inside, not shown, which drives an oil pump 74. Oil pump 74 provides a means of transporting oil from an oil storage tank, not shown, to burner 200. Control system 300 also energizes a liquid circulator 71 via a liquid circulator wiring 76. Circulator 71 is a pump that circulates heated liquid from its source to assembly 100 located inside burner 200 via a heated liquid supply line 72 and a heated liquid return line 73. As shown in FIG. 8, this heated liquid source is boiler 70. However, the heated liquid source could also be from any convenient location.

OPERATION OF INVENTION

Please refer to FIGS. 7 and 8 for this section. When the heating appliance calls for heat, such as boiler 70, a thermostat switching device, not shown, usually mounted on boiler 70 will close an electrical circuit. This energizes primary controller 52 via primary controller wiring 77 and liquid circulator 71 via liquid circulator wiring 76. Primary controller 52 is set up with a prepurge circuit, known by anyone skilled in the art, which typically will energize motor 54 which drives a blower wheel, not shown, inside burner 200 typically for a period of 15 to 30 seconds prior to energizing ignition transformer 53, solenoid valve 59 and the motor, not shown, which drives oil pump 74. This prepurge process forces air through the heating appliance and purges it of explosive combustion gases prior to ignition. Since liquid circulator 71 is energized during the prepurge process, heated liquid is pumped from a heated liquid source, such as boiler 70, to preheat device 1 causing it to increase in temperature and heat the oil inside preheat device 1 as was described earlier in reference to FIGS. 3, 4, 5 and 6. After the prepurge and preheat process is complete, combustion occurs as primary controller 52 energizes ignition transformer 53, solenoid valve 59 and the motor, not shown, which drives oil pump 74. Ignition transformer 53 sends high voltage to igniter 3 which travels through it and emits an electrical plasma arc across the tips of igniter 3 above nozzle 2. Solenoid valve 59 opens allowing oil to flow from oil pump 74 via oil line 75 to assembly 100 located inside burner 200 and ultimately to nozzle 2 where it is sprayed and atomized. Finally, the oil spray is ignited by igniter 3 producing combustion of the preheated atomized oil. This combustion process will continue until the thermostat of the heating appliance, not shown, opens and de-energizes control system 300 and primary controller 52.

For safety purposes, primary controller 52 also has a flame sensor, not shown, wired to it located inside burner 200, which monitors the combustion flame. In the event that the flame were to fail, primary controller 52, in conjunction with the flame sensor, will shut the system down and lock it out preventing another burn cycle. The issue that caused the flame failure must be fixed and primary controller 52 must be reset before primary controller 52 will allow another burn cycle.

In essence, with the exception of energizing liquid circulator 71, this invention within burner 200 is operated the same as a typical fuel oil burner.

Referring to FIG. 8, in order to heat boiler 70 from a cold start with this invention, or when using this invention on a furnace, not shown, a liquid heater 78 inline between liquid circulator 71 and burner 200 would provide the heated liquid. As mentioned earlier, the heated liquid can come from any source heated by any method.

When this invention is installed on a boiler, the boiler provides the heated liquid. The liquid is actually heated by the combustion process itself. Therefore, no electricity is consumed to create the heat energy needed for preheating oil.

High temperature boiler's liquid temperature is typically set at around 80 degrees Centigrade. This temperature works well for preheating most oils regardless of viscosity. With this inventions method of preheating, oil can not be heated any hotter than the heated liquid temperature. Oil fuels, virgin or used, are not vulnerable to carbonizing at temperatures lower than 90 degrees Centigrade.

With the exception of preheat device 1, all of the components mentioned can be purchased through HVAC equipment parts dealers. Preheat device 1 is made from an inorganic material, preferably aluminum for ease of machining, but could be made out of any thermally conductive material that can withstand the elements of the environment to which it is installed. The passageways mentioned above are machined into the block using typical machining methods such as drilling or boring. The access holes produced from drilling connecting passageways are either welded shut and machined smooth, as shown, or plugged with a pipe fitting, not shown.

This invention has the unique ability to provide a means of preheating oil for combustion using heat energy created by the combustion process itself. The method of preheating oil that this invention uses provides many advantages, as described above. The main principal of this invention is transferring heat energy from a heated liquid to oil in order to incinerate oil in a combustion process. The liquid used to convey heat energy to the oil can take the abuse of higher temperatures with out carbonizing. Also, the use of a heated liquid provides consistent oil preheat temperature with minimal oil temperature fluctuations with out overheating the oil.

Although the detailed description above contains many specificities, these should not be construed as limiting the scope of this invention, but rather as an exemplification of preferred embodiments thereof. Many other variations are possible. For example, the sizing of components described was omitted because they are determined by the amount of heat energy needed by the heating system installation. Component sizing is a function of the heat output required by burner 200 for the heating appliance to which it is attached. The overall dimensions of preheat device 1 will vary according to the oil flow rate needed by the heating system to which burner 200 is providing heat. Control system 300 configuration and the adding or subtracting of components thereof is determined by the heating system requirements and variable elements of the installation environment. Control system 300 may need additional components to meet differing safety codes.

As mentioned above this invention can be set up to atomize oil using the compressed air atomization method or high oil pressure method. If set up to use the air atomizing method, preheat device 1 could be manufactured including the compressed air passageway comprising of compressed air channels 40, 41 and 42. Nozzle 2 would need to be an air atomizing type nozzle. If set up to use the high oil pressure method, compressed air channels 40, 41 and 42 could either be omitted from preheat device 1 or simply plugged at the entrance of channel 40 using a typical pipe plug. Nozzle 2 would need to be a high oil pressure type nozzle. The compressed air channels 40, 41 and 42 give the end user the benefit of choosing which atomization method to use by simply installing the appropriate nozzle.

Assembly 100 can be installed into any fuel oil burner, such as the one shown in FIG. 7 manufactured by R. W. Beckett of Elyria, Ohio. Assembly 100 can be configured to work with many other manufactures of oil burners or a custom burner could be fabricated.

Preheat device 1, shown in FIG. 7, is located inside air tube 51 of burner 200. Another location would be to mount preheat device 1 external to air tube 51 with nozzle 2 remaining inside air tube assembly 51 with a tube connecting nozzle 2 to preheat device 1. Preheat device 1 shown in FIGS. 1 through 7 show the preferred embodiment. It is shown having been manufactured by machining channels into a block. However, it could also be manufactured using tubing placed or connected to one another so that heat energy can conduct through the tubing.

It is the essence of this invention to utilize a heated liquid that can take exposure to high temperatures and continual reheating without carbonizing to convey heat energy to oil prior to combustion. Doing so stabilizes the oil preheat temperature minimizing temperature fluctuations and minimizes carbon creation and coagulation of interior oil channel walls due to overheating as found within the prior art's preheat device.

The specificities of control system 300 and burner 200 in FIG. 8 show the preferred method of operating this invention, preheat device 1, in a typical application. However, this invention is applicable to many different known variations and configurations of control systems and burners known and available in the HVAC market.

Referring to FIG. 8, oil pump 74 can be fastened to burner 200 and driven by motor 54. Oil pump 74 can also be independently operated as is usually found in the multi oil combustion industry.

Many of the fastening, connection and wiring means, and other components utilized in this invention are widely known and used in the field of the invention described. Their exact nature or type is not necessary for an understanding and use of the invention by a person skilled in the art or science, and they will not therefore be discussed in significant detail.

Further, the various components shown or described herein for any specific application of this invention can be varied or altered as anticipated by this invention. This invention comprises a unique combination of elements, each element of which can be accomplished by one of several different means or variations for a specific application of this invention. The practice of a specific application of any element may already be widely known or used in the art or by persons skilled in the art or science, and each will not therefore be discussed in significant detail.

Thus, the scope of this invention should be determined not solely by the embodiments illustrated, but by the appended claims and their legal equivalents.

The invention I claim is:

1. An oil burner assembly, comprising:

a) an oil distribution nozzle;

b) a manifold i) constructed of a unitary body of thermally transmissive material and ii) having first and second continuous passageways, wherein each of said first and second passageways terminates at separate inlet and outlet ports, wherein said oil distribution nozzle is coupled to the outlet port of said first passageway;

c) a source of oil coupled to the inlet port to said first passageway such that the oil flows through said first passageway and is discharged from said nozzle;

d) a source of heated liquid coupled to the inlet and outlet ports of said second passageway to flow through said second passageway such that the heated liquid flow heats the manifold and transfers heat to oil in the first passageway to elevate the temperature of oil flowing in said first passage way as the oil is discharged from the nozzle; and e) an igniter mounted to said manifold and aligned to said nozzle to ignite the heated oil discharges from said nozzle; and wherein the outlet port of the first passageway includes first and second cavities, wherein said second cavity is coaxially aligned upstream of said first cavity, wherein an oil distribution portion of said nozzle mounts in said first cavity, and wherein the manifold includes a third passageway that terminates in said second cavity.

2. An oil burner assembly as set forth in claim 1 wherein said nozzle comprises an oil and air distribution nozzle, wherein the manifold includes a third passageway that terminates in said second cavity, wherein an air distribution portion of said nozzle mounts in said second cavity, and including a source of pressurized air coupled to an inlet port to said third passageway such that air is heated in said third passageway prior to being discharged from the nozzle to atomize heated oil discharged from the nozzle.

3. An oil burner assembly as set forth in claim 2 wherein said second passageway comprises a plurality of convoluted portions.

4. An oil burner assembly as set forth in claim 2 wherein a narrowed of said third passageway includes a plurality of narrowed portions that coupled to said second cavity and wherein said second cavity abuts and is concentrically aligned to said first cavity.

5. An oil burner assembly, comprising:

a) an oil and air distribution nozzle;

b) a manifold i) constructed of a unitary body of thermally transmissive material and ii) having first, second and third continuous passageways, wherein said first passageway terminates in first and second coaxially aligned cavities, wherein said second cavity is coupled upstream of said first cavity, wherein an oil distribution portion of the nozzle mounts in said first cavity and an air distribution portion of the nozzle mounts in the second cavity, and wherein said third passageway terminates at said second cavity;

c) a source of oil coupled to an inlet port to said first passageway such that the oil flows through said first passageway and is discharged from said nozzle;

d) a source of heated liquid coupled to an inlet port to said second passageway to flow through said second passageway to an outlet port such that the liquid flow heats the manifold and transfers the heat to elevate the temperature of oil flowing in said first passageway to a combustible temperature as the oil is discharged from the nozzle;

e) a source of pressurized air coupled to an inlet port to said third passageway such that the air is heated via heat transferred from the liquid as the air flows through said third passageway prior to being discharged from the nozzle to atomize the heated oil discharged from the nozzle; and f) an igniter mounted to said manifold and aligned to nozzle to ignite the heated and atomized oil discharged from said nozzle.

6. An oil burner assembly as set forth in claim 4 wherein said third passageway comprises a first portion and a plurality of second portions that branch from said first portion, wherein said second portions exhibits longitudinal cross-sections smaller than a longitudinal cross-section of said first portions, and wherein said second portions couple to said second cavity.

7. A method of operating an oil burner, comprising the steps of:

a) providing a source of oil;

b) providing a source of heated liquid;

c) providing a manifold coupled to an oil distribution nozzle, wherein said manifold is constructed of a thermally transmissive block of metal, wherein first and second displaced, continuous channels are formed into said manifold and respectively terminate at separate inlet and outlet ports, and wherein an oil distribution portion of the nozzle is coupled to the outlet port of said first channel;

d) coupling said source of oil to the inlet port to said first channel and said source of heated liquid to the inlet and outlet ports of said second channel and wherein said first and second channels are arranged in said manifold such that liquid flowing through said second channel transfers heat to oil flowing in said first channel to elevate the temperature and said oil to a combustible temperature as the heated oil is discharged from the nozzle; and e) igniting the heated oil upon discharge from the nozzle oil distribution port; wherein said nozzle comprises an oil and air distribution nozzle, wherein said manifold includes a third channel terminating at inlet and outlet ports, wherein said third channel comprises a first portion and a plurality of second portions that branch from said first portion, wherein said second portions exhibit longitudinal cross-sections narrower than a longitudinal cross-section of said first portion.

8. A method as set forth in claim 7 wherein said second portions couple to an air distribution portion of said nozzle and including the steps of providing a source of pressurized air and couple said air source to the inlet port to said third channel such that the air is heated in said third channel prior to being discharged from the nozzle to atomize heated oil discharged from the nozzle.

* * * * *